United States Patent [19]

Malecki

[11] 4,140,102

[45] Feb. 20, 1979

[54] KNOCK-DOWN FIREPLACE GRATE

[75] Inventor: Alexander J. Malecki, Warminster, Pa.

[73] Assignee: General Home Products Corporation, Pennsauken, N.J.

[21] Appl. No.: 727,636

[22] Filed: Sep. 29, 1976

[51] Int. Cl.[2] ..... F23H 17/08

[52] U.S. Cl. ..... 126/164; 126/165; D7/207

[58] Field of Search ..... 126/164, 165, 298, 336; D7/206, 207

[56] References Cited

U.S. PATENT DOCUMENTS

| | | | |
|---|---|---|---|
| D. 216,261 | 12/1969 | Hamilton | D7/206 |
| 909,756 | 1/1909 | Cherry | 126/164 |
| 2,926,657 | 3/1960 | Ford | 126/165 |
| 4,000,732 | 1/1977 | White | 126/165 |

*Primary Examiner*—John J. Camby
*Assistant Examiner*—Larry I. Schwartz
*Attorney, Agent, or Firm*—Nelson E. Kimmelman

[57] ABSTRACT

A fireplace grate for holding logs which, apart from assembling nuts and bolts, is comprised of a first plurality of identical arcuate segments and a second plurality of identical spacer rods. This grate may be shipped knocked-down and can easily be assembled by the average householder. Since it is comprised of only two sets of elements, one of which is flat and narrow, and the other is tubular, the knocked-down grate can be produced inexpensively and packaged compactly with relative ease.

8 Claims, 2 Drawing Figures

KNOCK-DOWN FIREPLACE GRATE

BACKGROUND OF THE INVENTION

1. Field of the Invention

This invention relates to fireplace equipment and in particular to an inexpensive, easily assemblable grate for holding logs.

2. Prior Art

Fireplace grates are known which are made of heavy cast iron or heat-resistant steel elements which are welded or otherwise secured to one another. The great majority are, however, shipped in assembled form, but since they are so relatively large, bulky, and heavy, shipping is a problem because of the expense and because their dimensions may not conform to applicable postal regulations. Other grates which are shipped in knocked-down form include a plurality of sets of parts which are so shaped that they are not capable of being packed compactly. It is therefore among the objects of the present invention to provide a fireplace grate comprised of a minimum number of sets of different parts, apart from assembly nuts and bolts, and which can be shipped, knocked-down, in an extremely compact form whether by parcel delivery services or even by mail.

SUMMARY OF THE INVENTION

The fireplace grate consists of means forming a cradle portion for holding combustibles which includes a plurality of substantially identical demountable planar segments secured together in substantially the same orientation and means connected to at least two of said planar segments for supporting said cradle portion.

DETAILED DESCRIPTION OF THE DRAWINGS

Figure 1:
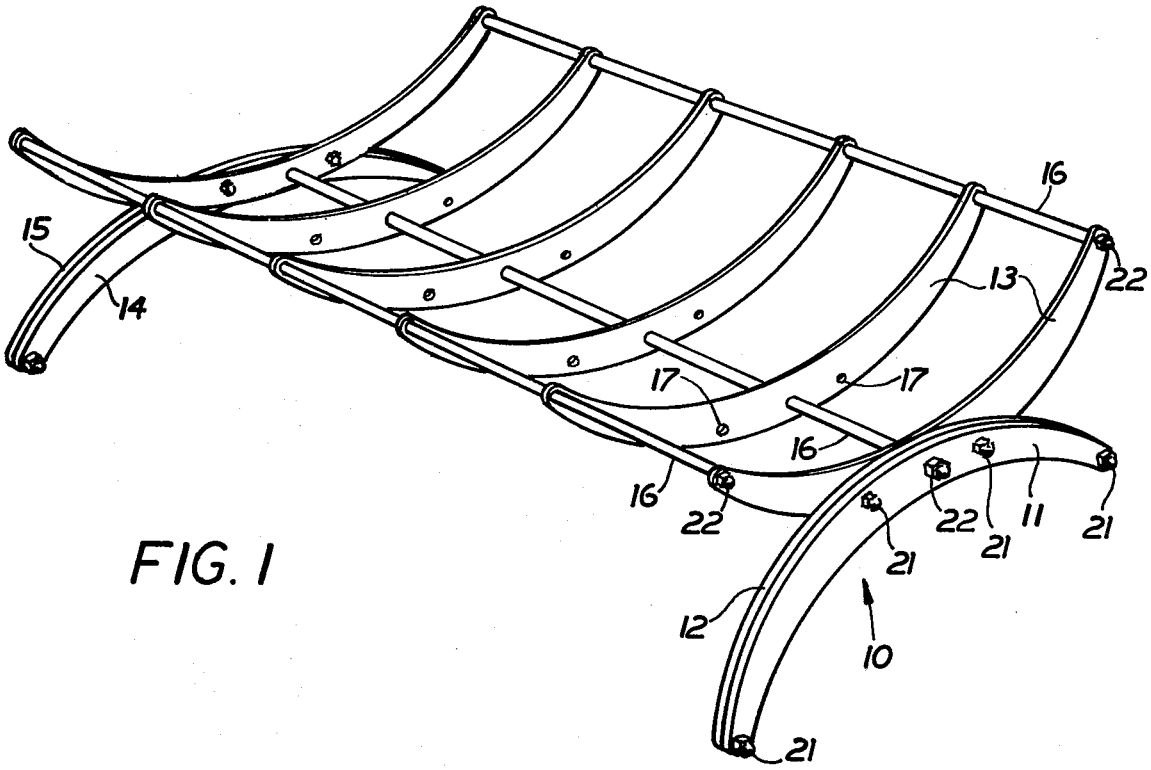
FIG. 1 is a perspective, assembly view of the apparatus according to the present invention.
Figure 2:
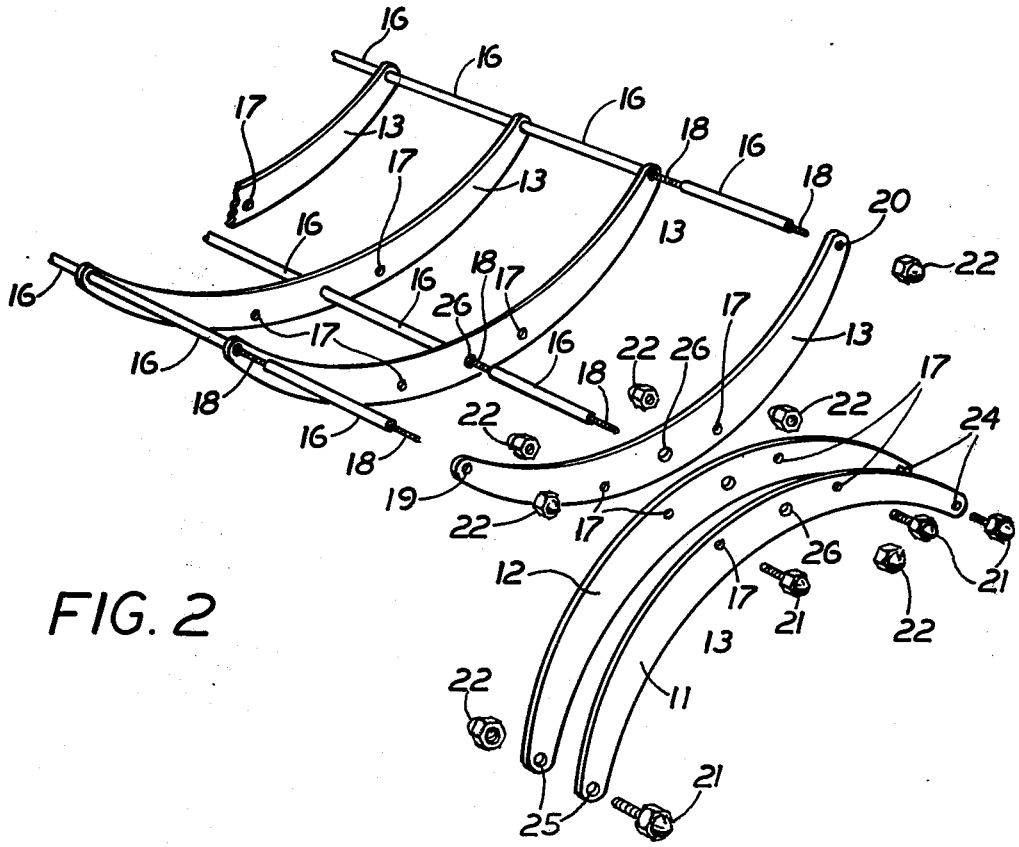
FIG. 2 is a fragmentary exploded view of a portion of the apparatus shown in FIG. 1.

Referring to FIGS. 1 and 2, there is indicated generally at the numeral 10, the fireplace grate according to the present invention. As may be seen, apart from the assembly bolts 18 and nuts 22, there are only two sets of main parts. The first set consists of a plurality of arcuate, generally planar metallic segments 13 which form a cradle for the logs. That set also includes the metallic segments 11, 12 and 14, 15 which are identical to segments 13 and which, when mounted opposite to the segments 13 constitute the supporting legs of the grate.

The second set comprises a plurality of tubular spacer members 16 which impart rigidity to the apparatus and keep the arcuate segments 13 spaced the proper distance from one another. They also help the structure withstand warpage of the members 13 due to the heat from the burning logs.

As may be seen, each of the arcuate segments 13 of the cradle has five apertures, two terminal apertures 19 and 20, central aperture 26 and two apertures 17 spaced equidistant from the central aperture 26. The terminal apertures 19 and 20 are provided to enable passage through them of the outer longitudinal bolt members 18 which are fastened in place externally by the capnuts 22. The outer bolts 18 also pass through intermediate ones of the spacer tubes 16 that are coaxially aligned with the terminal holes 19 and 20.

The central apertues 26 are also traversed by a central elongated bolt 18 which passes through a corresponding number of tubular spacing members 16. However, their ends pass through the central apertures 26 of the pair of arcuate segments 11, 12 on one end and of 14, 15 on the other end. The ends of the central bolt are retained by capnuts 22.

The two sets of holes 17 in the arcuate members play a part in adding to the stability of the mechanism supporting the cradle at each end. As seen in FIG. 2, holes 17 in the arcuate segment 13 at the right end of the cradle portion are positioned so as to be aligned with the corresponding holes in the inverted segments 11 and 12. They are clamped thereto by a bolt 21 which passes through the three aligned holes 17 from the outside and whose inner end is secured by nut 22. The other ends of the cradle portion are similarly disposed. Ordinarily, the holes 17 in the arcuate segments 13 of the central part of the cradle portion are not used, but they are formed in those segments anyhow to simplify manufacturing. It is therefore not necessary to have more than two main sets of components other than the assembling bolts and nuts. If it is desired to increase the strength and stability of the grate, two additional, slightly longer, bolts 18 can be passed through holes 17 and through additional spacers 16.

The terminal holes 24 and 25 in the leg segments 11, 12 and 14, 15 enable those pairs of segments to be bolted together by bolts 21 and nuts 22. Those segments are bolted together to provide additional strength to support the cradle portion. As a matter of fact, more arcuate segments can be bolted together in order to increase the supporting strength.

It is seen that when this grate is shipped in a knocked-down state, all of the segments 13 can be neatly and congruously arranged in one or more stacks. The short tubular segments 16 are likewise capable of being disposed in a very compact form together with the assembly bolts 18 and the various nuts. This makes for an extremely compact package which more easily can conform to size limitations of public mail or private delivery services.

Although the form of the invention previously explained comprised a number of arcuate segments forming both the cradle portion and the supporting legs, it should be recognized that the planar segments could assume somewhat different in shape. For example, instead of being crescentshaped, they could be planar C-shaped segments having parallel straight leg portions perpendicular to the long intermediate straight portion. Or they could be combinations of both, i.e., the cradle portion could be composed of arcuate planar segments and the supporting legs could be C-shaped planar segments. As another alternate embodiment, all of the segments of the cradle portion could be made so that each has an upper arcuate portion like the portions 13 and a lower integral portion in the form of a rectangular base portion or other shape (such as an inverted arcuate portion) that would rest directly on the hearth. Thus the grate is made entirely of identical composite elements and its cradle is self-supporting and has no need for a different construction or assembly at both ends, or some combination of such composite elements and segments could be used.

Still other embodiments are possible and will occur to one skilled in the art without departing from the essence of the present invention.

What is claimed is:

1. A fireplace grate comprising:

(a) a cradle portion for holding combustibles which includes a plurality of apertured, substantially identical planar segments and means including threaded means engaging said apertures for maintaining them in substantially identical orientation and in predetermined spatial relation to one another, (b) means disposed below said cradle portion for supporting the latter, said supporting means including a selected number of substantially planar apertured segments which have substantially identical configurations to said planar segments of said cradle portion and oriented opposite to the orientation of the segments of said cradle portion, and (c) threaded means engaging predetermined ones of said apertures for connecting said (a) and (b) means to one another in a manually releasable mechanical manner.

2. The fireplace grate according to claim 1 wherein said planar segments of said cradle portion are substantially arcuate.

3. The fireplace grate according to claim 1 wherein said supporting means includes a plurality of sets of said planar segments, each set comprising at least two of said last-named planar segments held in abutting juxtaposition to one another.

4. A fireplace grate comprising:

(a) a cradle portion for holding combustibles which includes a plurality of substantially identical planar segments and means for maintaining them substantially identically oriented and in fixed spatial relation to one another, said last named means comprising a plurality of tubular members disposed between said segments, said segments having a selected number of sets of apertures formed therein and said tubular members being arranged between corresponding aligned ones of said apertures, and (b) means for supporting said cradle portion which includes a selected number of substantially planar segments connected to said cradle portion and oriented opposite to the orientation of the segments of said cradle portion.

5. The fireplace grate according to claim 4 with the addition of a plurality of elongated rigid members passed through said tubular members and the apertures in said segments aligned therewith and means for retaining said elongated members in place.

6. The fireplace grate according to claim 5 wherein there are at least three of said elongated members having threaded terminal portions and wherein the planar segments of said cradle portion and of said supporting means are substantially identical.

7. A fireplace grate comprising:

(a) a cradle portion, said cradle portion being adapted to engage fireplace logs or other solid combustibles, said cradle portion comprising a plurality of arcuate segments which are generally planar, said arcuate segments having a plurality of sets of apertures, all of the apertures in each set being located at the same position on each segment, (b) a plurality of tubular spacing members disposed respectively between adjacent one of said arcuate segments between corresponding sets of said apertures and coaxially with one another, (c) a plurality of elongated members which pass through said respective sets of apertures and the tubular spacing members, and (d) first and second means for supporting said cradle disposed at opposite ends of said cradle and connected thereto, each of said first and second supporting means comprising a selected number of said arcuate segments connected to one other and being oriented in a vertical plane opposite to the orientation of the arcuate segments of the cradle portion.

8. A fireplace grate comprising:

(a) a cradle portion for holding combustibles which includes a plurality of substantially identical planar segments and means for maintaining them in substantially identical orientation and in predetermined spatial relation to one another, said means for maintaining them comprising a plurality of tubular members disposed between said segments, and (b) means attached to said cradle portion for supporting the latter, said supporting means including a selected member of substantially planar segments which have substantially identical configurations to said planar segments of said cradle portion and oriented opposite to the orientation of the segments of said cradle portion.

* * * * *